US006442785B1

(12) United States Patent
Robinson

(10) Patent No.: US 6,442,785 B1
(45) Date of Patent: Sep. 3, 2002

(54) DENTAL BRUSH WITH ENHANCED BRISTLES

(76) Inventor: Dane Q. Robinson, 8330 E. Captain Dreyfus Ave., Scottsdale, AZ (US) 85260

( * ) Notice: Subject to any disclaimer, the term of this patent is extended or adjusted under 35 U.S.C. 154(b) by 0 days.

(21) Appl. No.: 09/408,816

(22) Filed: Sep. 29, 1999

(51) Int. Cl.[7] ..... A46B 9/04; A46B 9/02; A46B 9/06

(52) U.S. Cl. ..... 15/167.1; 15/22.1; 15/200; 15/207.2; 15/DIG. 5; 15/DIG. 6

(58) Field of Search ..... 15/186, 197, 198, 15/200, 207.2, DIG. 6, 167.1, 22.1, DIG. 5

(56) References Cited

U.S. PATENT DOCUMENTS

| | | | | | |
|---|---|---|---|---|---|
| 795,062 | A | * | 7/1905 | Pollmann | 15/197 |
| 2,845,648 | A | * | 8/1958 | Peterson | 15/207.2 |
| 3,016,554 | A | * | 1/1962 | Peterson | 15/207.2 |
| 3,055,034 | A | * | 9/1962 | Halg | 15/197 |
| 3,343,195 | A | * | 9/1967 | Menges | 15/198 X |
| 4,247,964 | A | * | 2/1981 | Lichliter et al. | 15/200 X |
| 4,263,691 | A | * | 4/1981 | Pakarnseree | 15/207.2 |
| 4,408,367 | A | * | 10/1983 | Pusterhofer | 15/200 X |
| 4,561,214 | A | * | 12/1985 | Inoue | 15/104.14 X |
| 5,352,025 | A | | 10/1994 | Huang | 300/21 |
| 5,964,508 | A | * | 10/1999 | Maurer | 15/200 X |

FOREIGN PATENT DOCUMENTS

| | | |
|---|---|---|
| JP | 10-248640 | 9/1998 |

* cited by examiner

*Primary Examiner*—Mark Spisich
(74) *Attorney, Agent, or Firm*—Seed IP Law Group PLLC

(57) ABSTRACT

A dental brush with enhanced bristles has a body including a grip and a head. Attached to the head are at least some bristles made from a shape memory alloy with a composition that allows for superelastic attributes at the operational temperature ranges of the dental brush. These superelastic attributes allow metal bristles to be used and provide the dental brush with increased operational life. Other attributes of the shape memory alloy bristles include a hydrophobic nature that discourages growth of bacterial colonies on and near the dental bristles. The shape memory alloy dental bristles are individually supported allowing greater variety. in positioning the bristles on the dental brush head. The height, thickness, and shape of the shape memory alloy bristles can also be tailored to increase effectiveness of the dental brush. Further aspects of the shape memory alloy dental bristles include coatings on the bristles to modify color, lubricity, surface hardness, and abrasivity.

30 Claims, 8 Drawing Sheets

DENTAL BRUSH WITH ENHANCED BRISTLES

TECHNICAL FIELD

The present invention relates generally to brushes, and more particularly, to dental appliances such as toothbrushes utilizing bristles.

BACKGROUND OF THE INVENTION

Dental brushes, for uses such as dental hygiene, share common limitations related to the physical properties of their brush bristles. One limitation posed by the bristles is that they quickly start to wear. Users are often slow to replace their dental brushes since many times the evidence of wear is not discernible to an untrained eye until the amount of wear far exceeds operational limits for the dental brush. Remedying worn dental bristles of a toothbrush typically requires replacement of the entire dental brush, or at least the replaceable head portion which holds the bristles. Factors associated with replacement include the logistics of locating and purchasing a replacement and the expense of acquiring a suitable replacement.

Another limitation found with bristles for typical dental brushes regards their general hydrophilic nature. This hydrophilic nature encourages retention of moisture, which fosters growth of bacterial colonies on and near the bristles. Also, typical dental bristles further impose limitations including those regarding length, thickness, color, shape, clustering, frictional coefficient of bristle surfaces, surface hardness, abrasiveness, and patterning of the dental bristles on dental brushes, all that can hinder the effectiveness and the appeal of the dental brush.

SUMMARY OF THE INVENTION

Aspects of the invention are directed to a dental brush configured to aid with dental hygiene. The dental brush includes a shape memory alloy wire configured as a component of bristles having an austenitic transformation finishing temperature. The bristles have an original shape and are configured to return to their original shape for any amount of deformation of the bristles below a maximum deformation. In some embodiments, the shape memory alloy bristles are positioned a distance from one another. The distance is at least a minimum spacing. The amount of deformation for the maximum deformation is independent from the distance for the minimum spacing. In another embodiment, the shape memory alloy bristles are arranged in closely packed tufts in contact with other bristles of the tuft.

The dental brush further includes a dental brush head sized, shaped, and configured to receive the shape memory alloy bristles. The shape memory alloy bristles are affixed to the head in a pattern configuration. The pattern configuration includes affixation points where the shape memory alloy bristles are affixed to the dental brush head. The affixation points are positioned on the dental brush head such that the spacing between each pair of bristles is at least the minimum spacing. The pattern configuration further includes the height of each shape memory alloy bristle dependent upon its affixation point.

The dental brush also has a handle including a grip portion and a receiving end portion. The receiving end portion of the handle is coupled to the dental brush head. Other aspects of the invention include the shape memory alloy bristle being at least at least 50% Ni and at least 40% Ti. Further aspects include the shape memory alloy bristles further comprising a coating configured to cover the shape memory alloy wire. The coated shape memory alloy wire has a surface coefficient of friction smaller than that of the surface of the shape memory alloy wire without the coating.

DETAILED DESCRIPTION OF THE INVENTION

Figure 1:
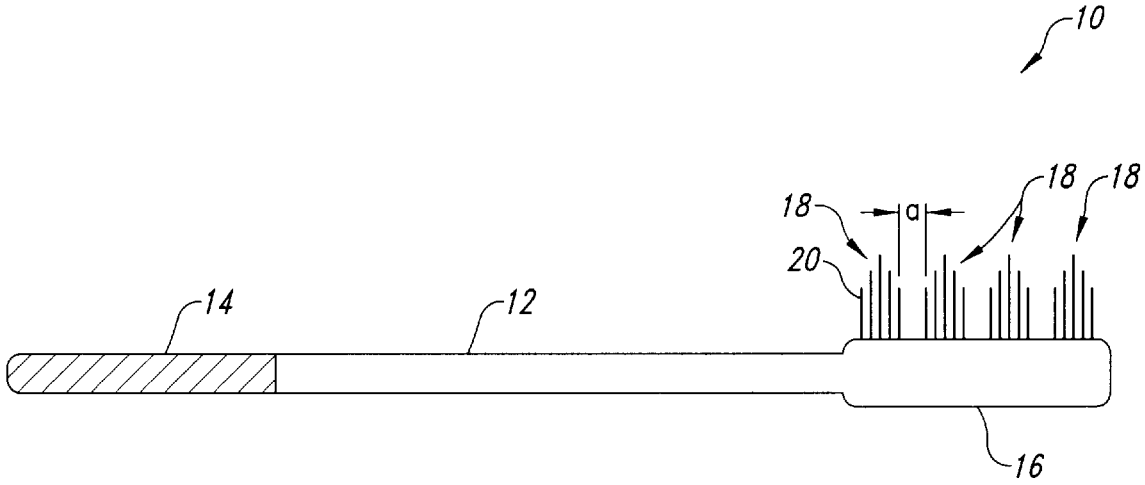
FIG. 1 is a side profile view showing a dental brush in accordance with the present invention.

As shown in the drawings for purposes of illustration, the present invention is embodied in a brush, such as the dental brush indicated generally by reference 10 in FIG. 1. The dental brush 10 of the depicted embodiment includes a body 12 having a grip 14 and a head 16. Attached to the head 16 are tufts 18 of metal wire dental bristles 20 generally spaced a distance "a" apart and made of a shape memory alloy of such composition to exhibit superelasticity at ranges of temperature experienced under typical use of the dental brush 10. In one embodiment, a shape memory NiTi alloy is used for the dental bristles 20 with 55.6% Ni and 44.4% Ti.

The brushes of the present invention utilize bristles of a material, including wire made from alloys of metallic materials having elastic properties referred to as superelasticity, also known as pseudoelasticity. Generally, these alloys also display behavior attributed to shape memory are sometimes referred to as shape memory alloys. An alloy with shape memory can be deformed below a first temperature and then will return to an original shape at a second temperature above the first temperature. There are a wide variety of alloys that have the shape memory effect. However, only a limited number are either sufficiently elastic or produces sufficient force in shape recovery to be used commercially.

Generally, various characteristics of these shape memory alloys are exhibited only in certain temperature ranges depending on the particular behavior of interest and the composition of a particular alloy involved. The shape memory alloys commonly exist in two forms known as the martensite and the austenite forms. For a particular shape memory alloy, the martensite form is generally weaker than the austenite form and the martensite form exists at a lower temperature range than the austenite form.

Figure 2:
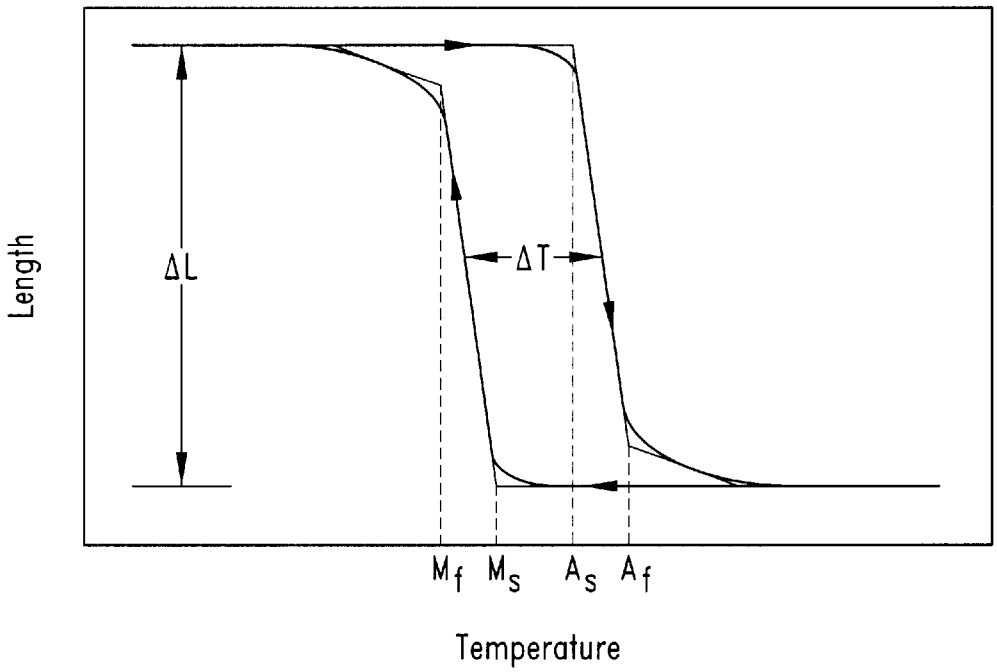
FIG. 2 is an elongation-temperature curve showing temperature dependent behavior of shape memory alloys.

The austenite form of a shape memory alloy undergoes a martensitic transformation over a range of temperatures and varies with the composition of each alloy. As shown in FIG. 2, the martensitic transformation starts at temperature $M_s$ and finishes at $M_f$. Most of the transformation happens in a relatively narrow range of temperature, however, the range between the starting temperature, $M_s$, and the finishing temperature, $M_f$, can be relatively large. FIG. 2 is a graph of elongation of a shape memory alloy versus temperature of the alloy under a constant load. For accurate determinations of the start and finish transformation temperatures more than one set of measurements can be taken at different loads to extrapolate back to a zero load condition or other more sophisticated methods of testing can be used.

The martensite form of a shape memory alloy also undergoes a austenitic transformation over a different range of temperatures beginning at a starting temperature, $A_s$, and ending at a finishing temperature, $A_f$, also shown in FIG. 2. In effect, a hysteresis exists so that the temperature ranges for the martensitic and austenitic transformations do not overlap.

Aspects of the present invention utilize superelastic properties of shape memory alloys that exist in a temperature range, the superelastic temperature range, starting at or slightly above the austenitic finishing temperature, $A_f$, and continuing for generally tens of degrees centigrade above the austenitic finishing temperature, $A_f$. The starting and beginning temperatures for the martensitic and austenitic transformations are very dependent upon the alloy composition including element types and percentage ratios of the elements used. Other factors that influence the characteristics of a particular alloy include the mechanical working and the heat treatment involved.

Figure 3:
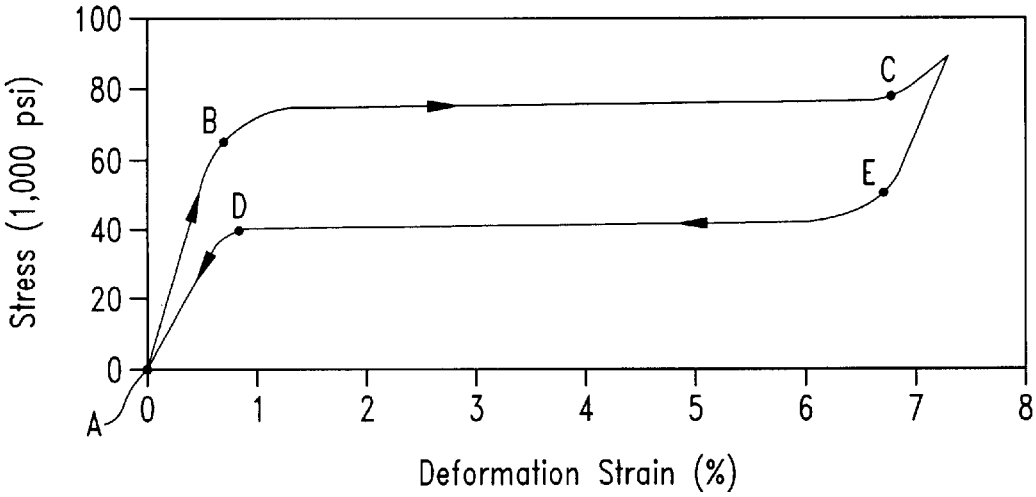
FIG. 3 is a stress-strain curve showing typical stress-relationships of superelastic metal.

When a shape memory alloy is at a temperature that is in its superelastic temperature range, the shape memory alloy is in a superelastic state that exhibits extremely elastic behavior as shown in FIG. 3. When the shape memory alloy is in its superelastic temperature range under no stress, all portions of the alloy will be in the austenite form of the alloy. However, when stress is applied to the shape memory alloy while it is in the superelastic temperature range, portions of the alloy will revert to its martensite form.

Upon introduction of stress, the shape memory alloy immediately strains in a rather linear fashion from point A to point B as shown in FIG. 3. After a certain amount of stress is applied, the alloy will then exhibit greater amounts of strain for much smaller increases in stress from point B to point C. After the alloy reaches a limit of strain past point C, further strain will require greater amounts of stress. As Long as the alloy is not strained past a certain point, however, the alloy will return to its original shape along the path of point C to point D and point D back to point A, once the stress is released.

The stress-strain curve shown in FIG. 3 is for a particular NiTi alloy which has a recovered elongation of approximately 8% in which the alloy can return to its original shape within less than ½% permanent set after being strained 8%. This great degree of elasticity can be appreciated when compared with a recovered elongation of 0.8% for a typical commercial alloy of stainless steel. The end result is that shape memory alloys can exhibit a very springy quality almost like rubber that is also very kink resistant when the alloy is in its superelastic temperature range. A material is kink resistant if it can be bent over on to itself and then will return to its original shape without permanent deformation.

Although some embodiments of the present invention may use various other superelastic alloys, including possible iron-base shape memory alloys, other embodiments use either nickel-titanium (NiTi) alloys or copper-base alloys such as CuZnAl and CuAlNi due in part to current commercial availability. The NiTi alloys have greater shape memory strain with up to 8% versus 4 to 5% for the copper-base alloys. The NiTi alloys are much more thermally stable and are more corrosion resistant than the copper-base alloys. The NiTi alloys are also highly biocompatible which is advantageous in some situations. The nickel in the NiTi is joined to the titanium with a strong intermetallic bond so reactions with even chemically sensitive people is relatively low when used for bristles 20 of the dental brush 10. The copper-base alloys are however, generally cheaper and have a wider range of potential transformation temperatures that may be useful for particular embodiments. Other embodiments also use nickel and titanium elements with additional elements such as iron, chromium, or copper.

NiTi alloys generally exhibit superelastic properties in a temperature range extending from the austenitic transformation finishing temperature, $A_f$, to approximately 50 degrees C above the finishing temperature, $A_f$. Some embodiments use a NiTi alloy of approximately 55.6% Ni and 44.4% Ti allowing selection of an $A_f$ temperature in a range between 20 to 40 degrees C so that the $A_f$ temperature is below body temperature. or below another temperature related to dental care. Other embodiments use various other ratios of nickel to titanium and some embodiments use additional elements such as chromium to assist in forming and manufacture of shape memory alloys or to further change the $A_f$ temperature.

By using a shape memory alloy in temperature ranges of the alloy's superelasticity for the dental bristles 20 of the dental brush 10 shown in FIG. 1, the dental brush obtains the benefits of the unique superelastic characteristics of the shape memory alloy. Metal wire has not been typically used for dental bristles due to the general inelastic nature of metal wire. However, use of the superelastic shape memory alloy wire for the dental bristles 20 allows use of metal wire for dental bristles and thereby also provides the benefit of other properties of the metal wire, such as durability and its hydrophobic nature. The durability characteristic of the shape memory alloy wire for the dental bristles 20 allows extended use of the dental brush 10, thereby greatly reducing and sometimes almost eliminating the need for replacement of the dental brush. The hydrophobic nature of the shape memory alloy dental bristles 20 discourages growth: of bacterial colonies on the dental brush 10 which promotes good dental hygiene and reduces the effort involved in properly caring for the dental brush.

Figure 4:
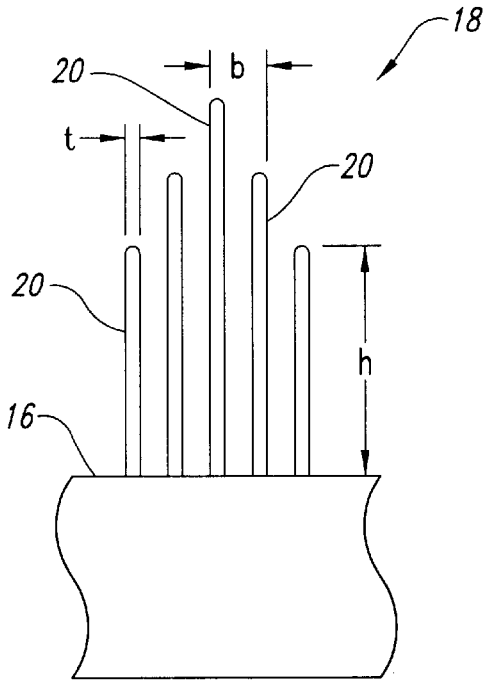
FIG. 4 is an enlarged, fragmentary side view of the dental brush of FIG. 1 showing a single tuft of bristles.
Figure 5:
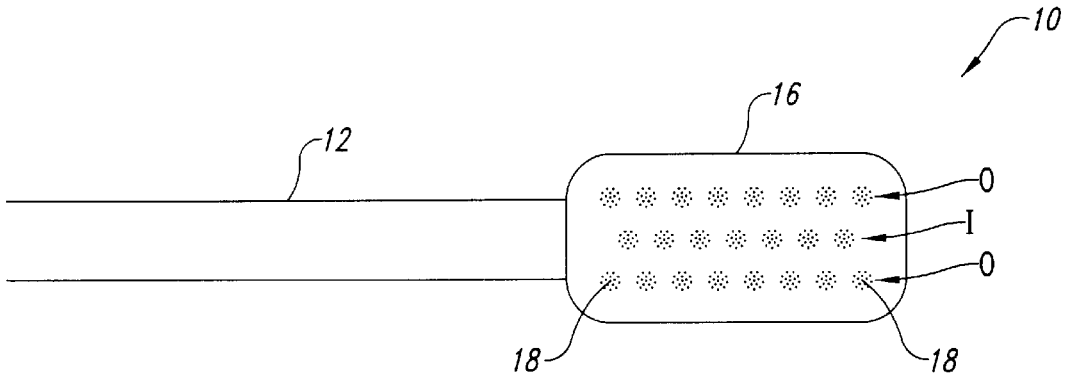
FIG. 5 is an enlarged, fragmentary bottom view of the dental brush of FIG. 1 showing a patterning of the tufts of bristles.
Figure 6:
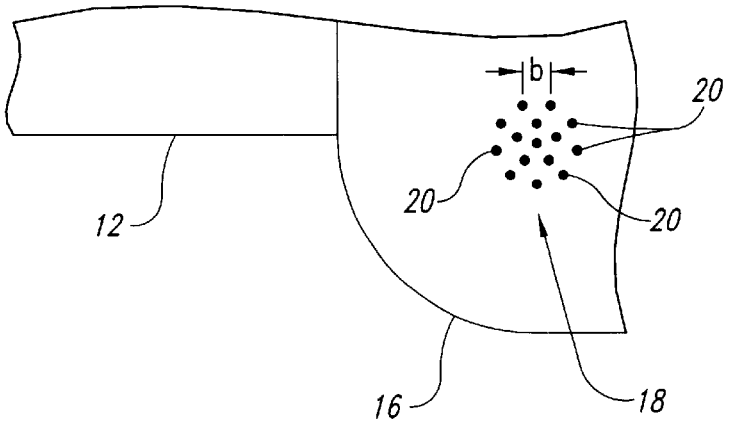
FIG. 6 is an enlarged, fragmentary bottom view showing the separation of the individual bristles of the tuft of the dental brush of FIG. 5.

Other advantages of using the shape memory alloy dental bristles 20 include the capability of separately locating the dental bristles on the dental brush head 16 for greater effectiveness of the dental brush 10. Unlike typical dental brush bristles, the shape memory :alloy dental bristles 20 are self-supporting and do not require a cluster or tuft of tightly packed bristles (although such may be used if desired). Instead, the individual bristles of the shape memory alloy dental bristles 20 can be spaced apart from each other, separated by relatively large gaps, indicated in FIG. 4, by letter "b", without adversely affecting bristle strength and resiliency to deformation. Some embodiments have gaps with a size of approximately 2 mm or a size of at least the smallest bristle diameter. Other embodiments have gaps that are either smaller or larger than 2 mm or the size of the smallest bristle diameter. The ability to independently locate individual dental bristles 20 since they can stand alone, avoids the need to pack many bristles tightly together so that they have sufficient support from each other. This allows for increased effectiveness of the dental brush 10 by permitting locating of the bristles based on which spacing or pattern of individual dental bristles achieves the optimum performance for the dental brush. Even when placed in the pattern of a tuft 18 of bristles, such as shown in FIGS. 1 and 4, the bristles 20 can be separated from each other if desired to produce a better performance or feel. This also allows placement or patterning of individual bristles in a bristle tuft based upon the length of the bristle, as shown in FIG. 4 with the taller bristles located toward the center of the tuft 18. The particular pattern of tufts 18 for the dental brush 10 of FIG. 1 is shown in FIG. 5, and the separation of the individual dental bristles 20 in one tuft 18 is shown in FIG. 6. As noted, the self-supporting nature of the shape memory dental bristles 20 allows for varying height, h, specifications for individual dental bristles 20, as shown for one representative tuft 18 in FIG. 4. Varying bristle height, h, along with individual separation of the dental bristles 20 allows for relatively deeper penetration in such locations as interproximal areas. Thus, individual bristle placement and height, h, can be tailored for each tuft 18 to produce a desired tuft shape and performance, in addition to using a desired tuft placement on the dental brush head 16. It is noted that the bristle height, h, used in the different tufts 18 can also be different from tuft to tuft if desired. Also, the number of tufts 18 can be varied as desired from one tuft to multiple tufts per dental brush head 16.

In an alternative embodiment, the shape memory alloy dental bristles 20 may be arranged in a cluster or tuft of tightly packed bristles as with a conventional toothbrush. The number of shape memory alloy dental bristles 20 which make up the tuft may be retained in a single recess in closely packed arrangement with the bristles of the tuft in contact with other bristles of the tuft. Such an arrangement is shown for tuft 18 in FIG. 9 with the plurality of shape memory alloy dental bristles 20 which make up the tuft affixed in a single recess.

Figure 7:
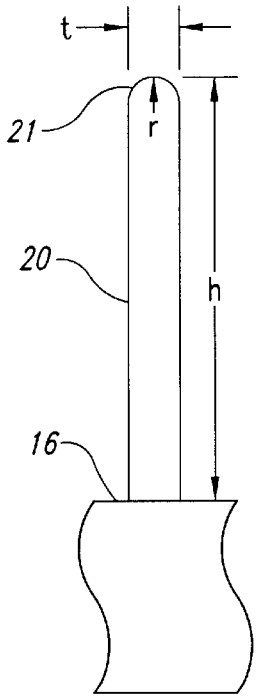
FIG. 7 is an enlarged fragmentary side view of the dental brush of FIG. 1, showing a single bristle of a tuft of bristles.

As noted, use of the shape memory alloy dental bristles 20 additionally provides the ability to tailor even the shape of each of the bristles, such as bristle thickness, t, and radius of bristle tip curvature, r, of a free end portion 21 of the bristles, as shown in FIGS. 4 and 7. A typical bristle thickness, t, would yield an extra soft-feeling bristle for a thickness of approximately 0.002 to 0.003 inches, a soft bristle for a thickness of approximately 0.004 inches, a medium bristle for a thickness of approximately 0.005 inches, a firm bristle for a thickness of approximately 0.006 inches, and an extra firm bristle for a thickness of 0.007+inches using an NiTi alloy of 55.6% Ni and 44.4% Ti. The bristle end portion 21 can be rounded with a radius of curvature, r, or flat, or shaped with other surface features according to a desired contact quality for the bristle end portion.

Figure 8A:
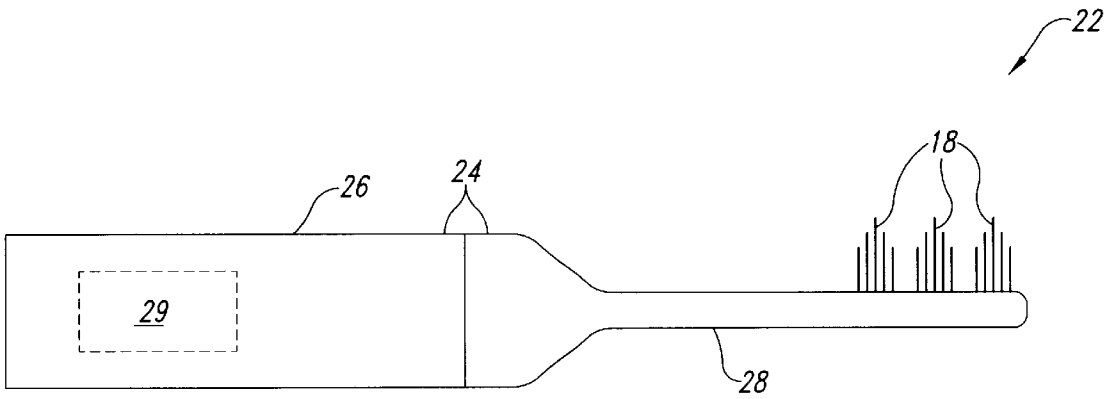
FIG. 8A is a side view showing an alternative mechanical embodiment of a dental brush in accordance with the present invention.
Figure 8B:
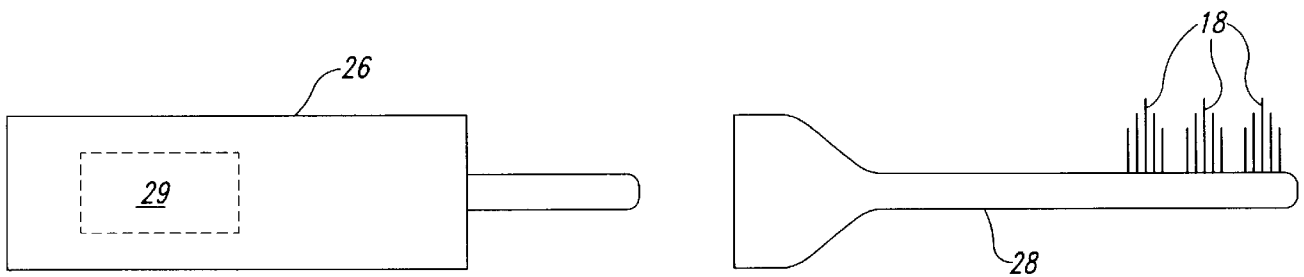
FIG. 8B is a side view showing the alternative mechanical embodiment of the dental brush of FIG. 8A in a second detached mode.

Alternative embodiments of the dental brush 10 include mechanical versions. One such mechanical embodiment is depicted in FIGS. 8A and 8B with a body 24 having a grip 26 removably attached to a mechanical head 28 having tufts 18 of shape memory alloy dental bristles 20. In some embodiments the grip 26 houses a motive source such as an electric motor 29 whereas the mechanical head 28 contains mechanical elements to transfer motion produced by the motive source to the dental bristles 20.

Figure 8C:
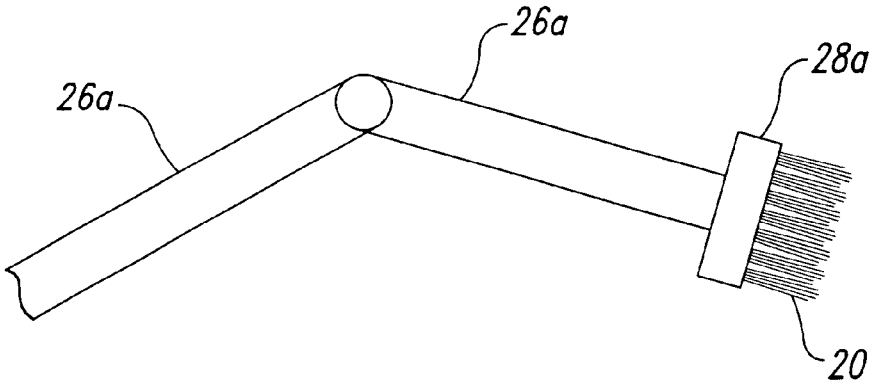
FIG. 8C is a side view showing an alternative mechanical embodiment of a dental brush in accordance with the present invention.
Figure 8D:
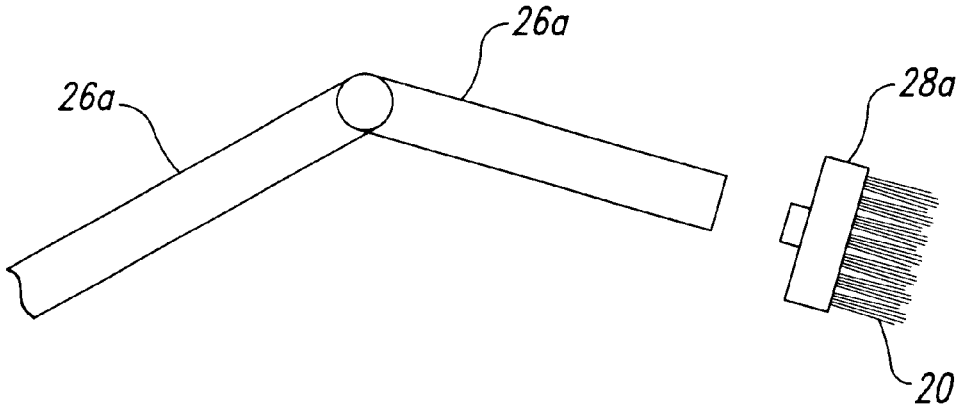
FIG. 8D is a side view showing the alternative mechanical embodiment of the dental brush of FIG. 8C in a second detached mode.

In other embodiments, another type of support member is used instead of the grip 26, such as an extending member 26*a*, shown in FIGS. 8C and 8D, used by health care providers such as dentists and dental hygienists for cleaning and repairing teeth. The support member, such as the extending member 26*a*, has a receiving end portion that is configured to receive a brush head member 28*a* so that the brush head member is coupled to the extending member. In some embodiments, the brush head member 28*a* is rotatably coupled to the extending member. The shape memory alloy dental bristles 20 are attached to the brush head member 28*a*. The receiving end portion of the extending member 26*a*, in some embodiments, is configured to couple to other items in addition to the brush head member 28*a* such as drill bits and grinding wheels. The extending member 26*a* may also be connected to a motive source (not shown) such as an electric motor to provide motive force to the brush head member 28*a*.

Using the shape memory alloy dental bristles 20 attached to the mechanical head 28 allows extended use of the mechanical head significantly beyond the replacement time of an equivalent mechanical head with typical prior art dental bristles. Replacement due to bristle wear rather than conventional mechanical failure is almost eliminated. Extension of operational life of the mechanical head 28 provides a potential for significant reduction in cost over the operational life of the conventional mechanical dental brush due to the typical relative high frequency and cost of replacement heads of equivalent prior art mechanical dental brush heads.

Figure 9:
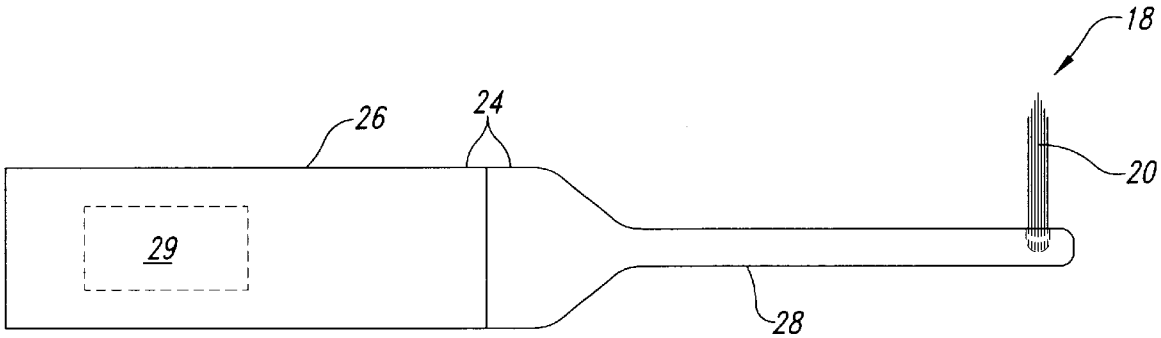
FIG. 9 is a side view showing an alternative embodiment of a dental brush having a single tuft of closely packed shape memory alloy bristle in accordance with the present invention.
Figure 10:
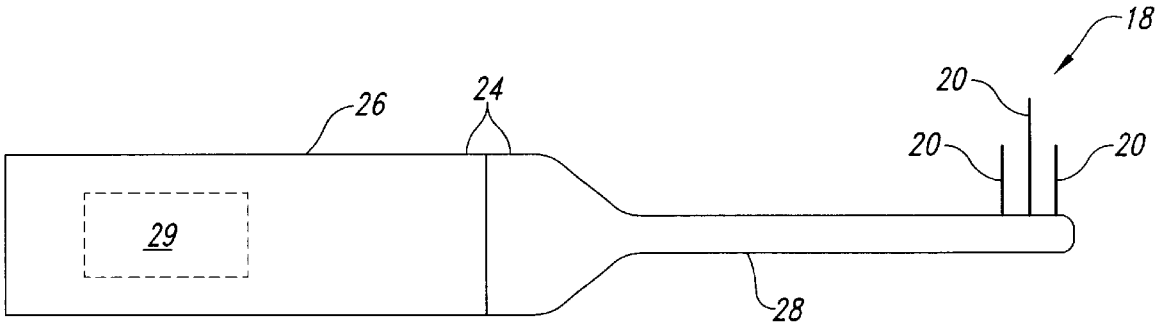
FIG. 10 is a side view showing an alternative embodiment of a dental brush having a few shape memory alloy bristles in accordance with the present invention.

Another manual or mechanical version shown in FIG. 9 can include a manual or mechanical head with a single tuft 18 of a plurality of shape memory alloy dental bristles 20 arranged in a closely packed arrangement in the single recess as described above. The bristles are in contact with each other as with a conventional toothbrush tuft. The mechanical head can produce rotation, translation or other desired motion of the single tuft using a motive source or be moved manually by the user grasping and moving a handle or grip. The form of the dental brush 10 may be the same as a conventional manual toothbrush in construction except for the use of the shape memory alloy dental bristles 20. The manual or mechanical heads can also include two or more separated bristles 20 or other desired patterns for the shape memory alloy dental bristles 20 such as shown in FIG. 10.

Figure 11:
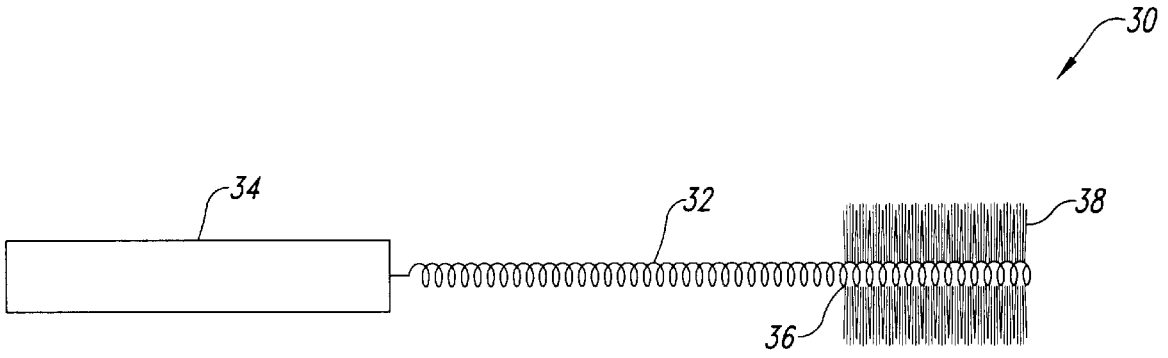
FIG. 11 is a side view showing an alternative proxy brush embodiment of a dental brush in accordance with the present invention.

An interdental dental brush 30 of another embodiment is shown in FIG. 11 and uses a shape memory alloy to form a core 32 of the dental brush. In this case a shape memory alloy provides superelastic characteristics to the core 32 which extends outward from a grip 34. The free end portion of the core 32 has shape memory alloy dental bristles 38 attached thereto. This embodiment finds application, for instance, with proxy brushes. The superelastic characteristics of the shape memory alloy used for the core 32 prevent its permanent deformation during use and its use for the bristles provides the benefits described above to greatly increase the overall utility of the proxy brush.

Figure 12:
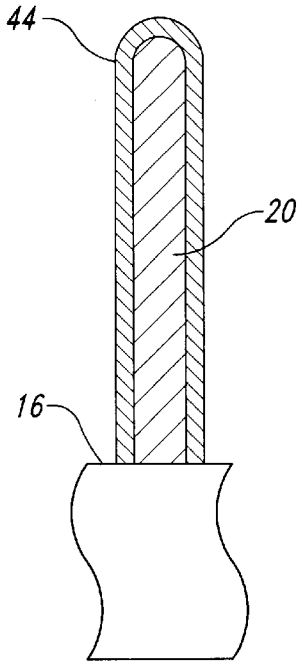
FIG. 12 is a side profile view showing an alternative embodiment of a bristle of the dental brush of FIG. 1 using a coating.

Embodiments using NiTi for the dental bristles 20 have a surface oxide primarily of $TiO_2$ naturally occurring through manufacture which is generally biocompatible and can. vary in color depending upon the manufacture process that forms the shape memory alloy bristle wire. As shown in FIG. 12, other embodiments use optional coatings 44 over the dental bristle 20. The coatings are used to modify attributes of the dental bristles 20 including color, lubricity, surface hardness, and abrasivity. These coatings and coating processes include paralene, anodization, tiadization, polytetrafluroethylene (PTFE), ionic PFTE, nylon, plastic, and chemical resin.

In other embodiments, the shape memory alloy dental bristles 20 are combined with traditional dental bristles. For instance, the bristle pattern shown in FIGS. 5 and 6 could have shape memory alloy dental metal bristles 20 used for the tufts 18 on the outside tuft rows, 0, and traditional bristles used for the inner tuft row, I. Other mixtures of shape memory alloy dental bristles 20 and traditional bristles can be used as desired.

Figure 13:
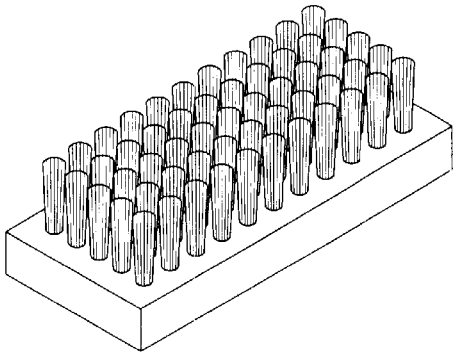
FIGS. 13–14 are isometric views of alternative embodiments of brushes using shape memory alloy bristles in accordance with the present invention.
Figure 14:
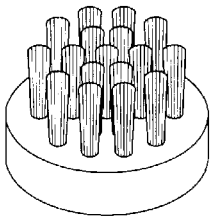
Figure 15:
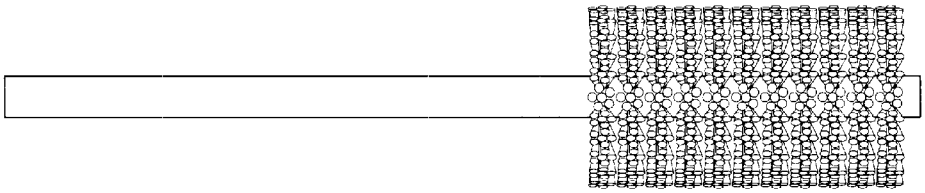
FIG. 15 is a side view of alternative embodiment of a brush using shape memory alloy bristles in accordance with the present invention.

Additional embodiments take advantage of the superelastic properties of shape memory alloy bristles for brushes and other devices (generally shown in FIGS. 13–15) such as hair brushes, scrub brushes, brooms, dust brushes, nail cleaner brushes, back cleaner brushes, shower brushes, bottle cleaning brushes, and surgery instrument scrub brushes. The dental brush 10 is an illustration of an embodiment for dental cleaning purposes and is not intended to limit the scope of the present invention to dental brushes.

From the foregoing it will be appreciated that, although specific embodiments of the invention have been described herein for purposes of illustration, various modifications may be made without deviating from the spirit and scope of the invention. Accordingly, the invention is not limited except as by the appended claims.

It is claimed:

1. A dental brush configured for operation in an operational temperature range to aid with dental hygiene, the dental brush comprising:

shape memory alloy wire configured as a component of bristles having an austenitic transformation finishing temperature such that the shape memory alloy wire is superelastic in the operational temperature range, the bristles having an original shape and configured to return to their original shape for any amount of deformation of the bristles below a maximum deformation, the shape memory alloy bristles positioned a distance from one another, the distance being at least a minimum spacing, the amount of deformation for the maximum deformation being independent from the distance for the minimum spacing;

a dental brush head sized, shaped, and configured to receive the shape memory alloy bristles, the shape memory alloy bristles affixed to the head in a pattern configuration, the pattern configuration including affixation points where the shape memory alloy bristles are affixed to the dental brush head, the affixation points positioned on the dental brush head such that the spacing between each pair of bristles is at least the minimum spacing, the pattern configuration further including the height of each shape memory alloy bristle dependent upon its affixation point; and a handle including a grip portion and a receiving end portion, the receiving end portion of the handle being attached to the dental brush head, wherein the shape memory alloy wire comprises at least 50% Ni and at least 40% Ti.

2. The brush of claim 1 wherein the shape memory alloy bristle further comprises a coating configured to cover the shape memory alloy wire, the coating being configured to modify an attribute of the shape memory alloy wire, the modified attribute selected from a list of attributes including color, lubricity, surface hardness, and abrasivity.

3. A dental brush configured to aid with dental hygiene, the dental brush comprising:

shape memory alloy wire configured as a component of bristles having an austenitic transformation finishing temperature, the bristles having an original shape and configured to return to their original shape for any amount of deformation of the bristles below a maximum deformation, the shape memory alloy bristles positioned a distance from one another, the distance being at least a minimum spacing, the amount of deformation for the maximum deformation being independent from the distance for the minimum spacing;

a dental brush head sized, shaped, and configured to receive the shape memory alloy bristles, the shape memory alloy bristles affixed to the head in a pattern configuration, the pattern configuration including affixation points where the shape memory alloy bristles are affixed to the dental brush head, the affixation points positioned on the dental brush head such that the spacing between each pair of bristles is at least the minimum spacing, the pattern configuration further including the height of each shape memory alloy bristle dependent upon its affixation point; and a handle including a grip portion and a receiving end portion, the receiving end portion of the handle being attached to the dental brush head wherein the pattern configuration further includes groupings of affixation points such that the shape memory alloy bristles are positioned into tufts wherein bristles within a tuft are spaced at least the minimum spacing from each other and bristles at the outer perimeter of each tuft are spaced a minimum tuft distance from outer perimeter bristles of other tufts.

4. The dental brush of claim 3 wherein the pattern configuration includes shape memory alloy bristles having affixation points toward a tuft center having greater height than bristles having affixation points further toward a tuft outer perimeter.

5. A dental brush, comprising:

a body including a grip portion and a head portion; and a plurality of bristles attached to the head portion of the body, the plurality of bristles comprising a shape memory alloy, having a superelastic temperature range at least spanning from 20 to 70 degrees C, wherein the shape memory alloy comprises at least 50% Ni and at least 40% Ti.

6. The dental brush of claim 5 wherein the shape memory alloy has an austenitic transformation finishing temperature, $A_f$, of at least 20 degrees C.

7. The dental brush of claim 5 wherein the bristles of the plurality of bristles are spaced at least 2 mm from each other.

8. The dental brush of claim 5 wherein each bristle of the plurality of bristles has a bristle diameter and each bristle is spaced from the other bristles of the plurality at least a distance equal to or greater than the smallest bristle diameter.

9. The dental brush of claim 5 wherein the plurality of bristles are divided into a plurality of tufts.

10. The dental brush of claim 5 wherein the plurality of bristles form one tuft.

11. The dental brush of claim 10 wherein the plurality of bristles of the one tuft are packed together in contact with others of the bristles.

12. The dental brush of claim 5 wherein the plurality of bristles form a plurality of tufts, each with a plurality of bristles.

13. The dental brush of claim 12 wherein the plurality of bristles of each tuft are packed together in contact with others of the bristles of the tuft.

14. The dental brush of claim 5 wherein the plurality of bristles include having end portions that are rounded.

15. The dental brush of claim 5 wherein the plurality of bristles have surfaces, the bristles being treated wherein the bristle surfaces receive an application of a coating that covers the surfaces of the treated bristles, the coating of the treated bristles having surfaces, the coating surfaces configured to have coefficients of friction lower than the bristle surfaces.

16. The dental brush of claim 5 wherein the plurality of bristles are treated by at least one of anodization, tiadization, or coating with paralene, polytetrafluroethylene (PFTE), ionic PFTE, nylon, plastic, or chemical resin.

17. The dental brush of claim 5, further comprising a second plurality of bristles attached to the head portion of the body, the second plurality of bristles being made from material other than a shape memory alloy.

18. The dental brush of claim 5 wherein a first portion of the plurality of bristles have heights that are different than the heights of a second portion of the plurality of bristles.

19. The dental brush of claim 5 wherein the head portion is removably attached to the grip portion of the body.

20. The dental brush of claim 5 wherein the head portion is fixedly attached to the grip portion of the body.

21. The dental brush of claim 5 wherein the grip portion of the body further contains a motive source configured to supply motive force to the plurality of bristles.

22. The dental brush of claim 21 wherein the motive source is an electric motor.

23. The dental brush of claim 5 wherein a portion of the body further comprises at least in part a shape memory alloy.

24. The dental brush of claim 5 wherein the bristles extend radially from the head portion of the body.

25. The dental brush of claim 5 wherein the bristles extend in a parallel bristle arrangement from the head portion of the body.

26. The dental brush of claim 5 wherein the plurality of bristles are arranged in tufts, wherein the height of a bristle in a tuft is dependent upon placement of the bristle in the tuft.

27. For a dental appliance having a support member with a receiving end, a brush head coupled to the receiving end of the support member, the brush head comprising:

a plurality of bristles comprising a shape memory alloy, having a superelastic temperature range at least spanning from 20 to 70 degrees C, wherein the shape memory alloy comprises at least 50% Ni and at least 40% Ti; and a brush head member, the plurality of bristles being attached to the brush head member, the brush head member being removably attached to the receiving end of the support member of the dental appliance.

28. The brush head of claim 27 wherein the brush head member is rotatably coupled to the receiving end of the support member.

29. For a dental appliance having a support member with a receiving end, a brush head coupled to the receiving end of the support member, the brush head comprising:

a plurality of bristles comprising a shape memory alloy, having a superelastic temperature range at least spanning from 20 to 70 degrees C, wherein the shape memory alloy comprises at least 50% Ni and at least 40% Ti, each bristle of the plurality of bristles being positioned on the brush head; and a brush head member, the plurality of bristles being attached to the brush head member, each bristle of the plurality of bristles being positioned on the brush head member at least a minimum spacing from each other, the brush head member being removably attached to the receiving end of the support member of the dental appliance.

30. The brush head of claim 29 wherein the brush head member is rotatably coupled to the receiving end of the support member.

* * * * *